US007699625B2

(12) United States Patent
Chen et al.

(10) Patent No.: US 7,699,625 B2
(45) Date of Patent: Apr. 20, 2010

(54) ELECTRICAL CONNECTOR

(75) Inventors: De-Jin Chen, ShenZhen (CN); Yu-San Hsiao, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 69 days.

(21) Appl. No.: 12/002,743

(22) Filed: Dec. 18, 2007

(65) Prior Publication Data

US 2008/0146084 A1 Jun. 19, 2008

(30) Foreign Application Priority Data

Dec. 18, 2006 (CN) ..... 2006 2 0171099

(51) Int. Cl.
*H01R 12/00* (2006.01)

(52) U.S. Cl. ..... 439/79; 439/733.1

(58) Field of Classification Search ..... 439/79, 439/80, 733.1

See application file for complete search history.

(56) References Cited

U.S. PATENT DOCUMENTS 7,517,233 B2 * 4/2009 Xiang ..... 439/79
2002/0197894 A1 * 12/2002 Konno et al. ..... 439/79
2004/0009685 A1 * 1/2004 Yamashita ..... 439/79
2004/0115969 A1 * 6/2004 Jou ..... 439/79
2004/0185692 A1 * 9/2004 Boonsue ..... 439/79

FOREIGN PATENT DOCUMENTS

CN 2831497 10/2006

* cited by examiner

*Primary Examiner*—Hien Vu
(74) *Attorney, Agent, or Firm*—Wei Te Chung; Andrew C. Cheng; Ming Chieh Chang

(57) ABSTRACT

An electrical connector includes a connector body (10) having a front end (11) and a rear end (12), a plurality of passageways (13) extending from the front end towards the rear end, and terminals (20) within the passageways. The terminal includes an extension section (26) extending a distance away from the rear end of the connector body. A supporting member (15) is disposed adjacent the rear end for supporting at least a portion of the extension section. Thus, the arrangement of the supporting member will prevent the free extension sections of the prior art from being deflected or damaged.

4 Claims, 4 Drawing Sheets

ELECTRICAL CONNECTOR

BACKGROUND OF THE INVENTION

1. Field of the Invention

The present invention relates to the art of electrical connectors.

2. Description of the Related Art

Chinese Pat. Issue No. 2831497 issued to Wang Shi-Yong on Oct. 25, 2006 discloses a related electrical connector. The electrical connector includes a connector body having thereof a front end and a rear end. Parallel upper and lower rows of passageways are configured to extend from the front end towards the rear end of the connector body. Upper and lower terminals are held within the two parallel rows of passageways. The respective upper and lower terminals include upper and lower outer tailing portions adapted to be mounted onto a mating component. In order to not interfere with the lower terminals, the upper terminals include upper extension portions attached thereto such that the upper outer tailing portions are set to extend a distance away from the rear end of the connector body. A problem, however, with such an electrical connector is that the upper tailing portions may be apt to be deflected or damaged due to having the upper tailing portions free from the connector body. Therefore, there is a need to provide a new connector to resolve the above-mentioned problem.

SUMMARY OF THE INVENTION

A major object of an embodiment of the present invention is to provide an electrical connector having a supporting member for supporting at least a portion of the extension section so as to prevent the free extension section of the prior art from being deflected or damaged by an external force.

An electrical connector according to an embodiment of the present invention includes a connector body having a front end and a rear end, a plurality of passageways extending from the front end towards the rear end, and terminals held within the passageways. At least one of the terminals includes an extension section extending a distance away from the rear end of the connector body. A supporting member is disposed adjacent the rear end for supporting at least a portion of the extension section.

Other features and advantages of the present invention will become more apparent to those skilled in the art upon examination of the following drawings and detailed description of preferred embodiments, in which:

DETAILED DESCRIPTION OF PREFERRED EMBODIMENT

Figure 1:
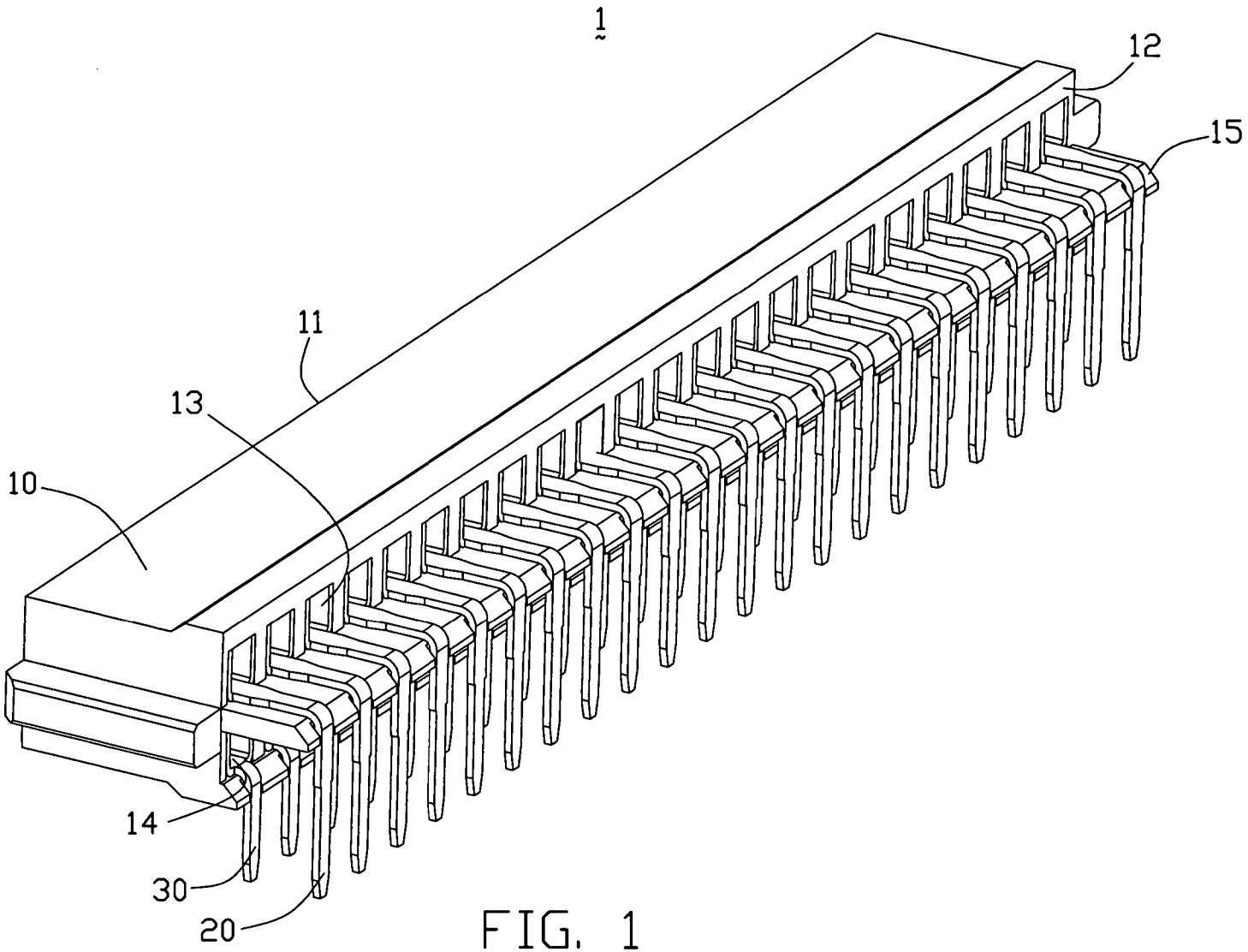
FIG. 1 is an assembled, perspective view of the electrical connector according to an embodiment of the present invention.
Figure 2:
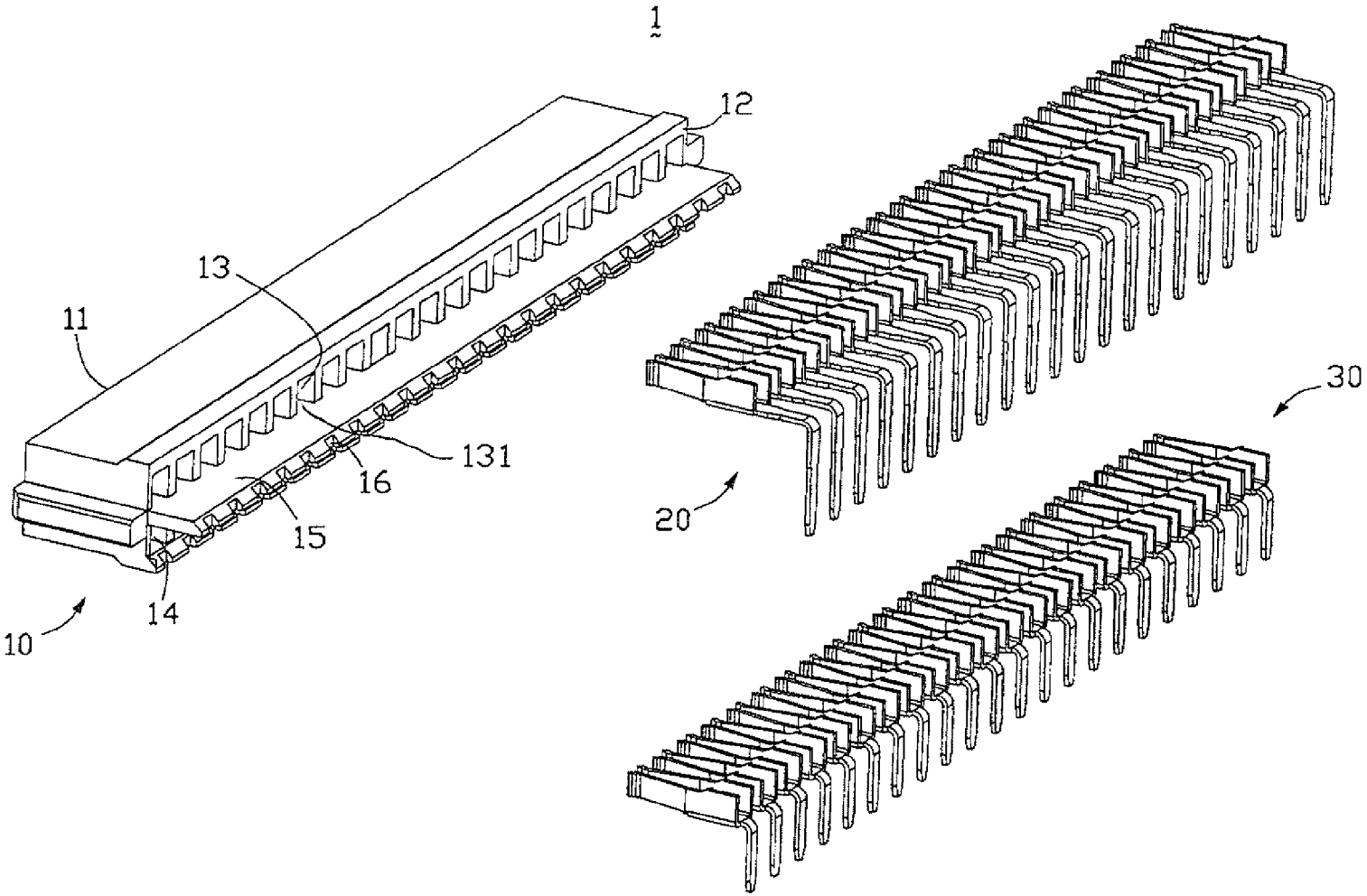
FIG. 2 is an exploded, perspective view of the electrical connector of FIG. 1.
Figure 3:
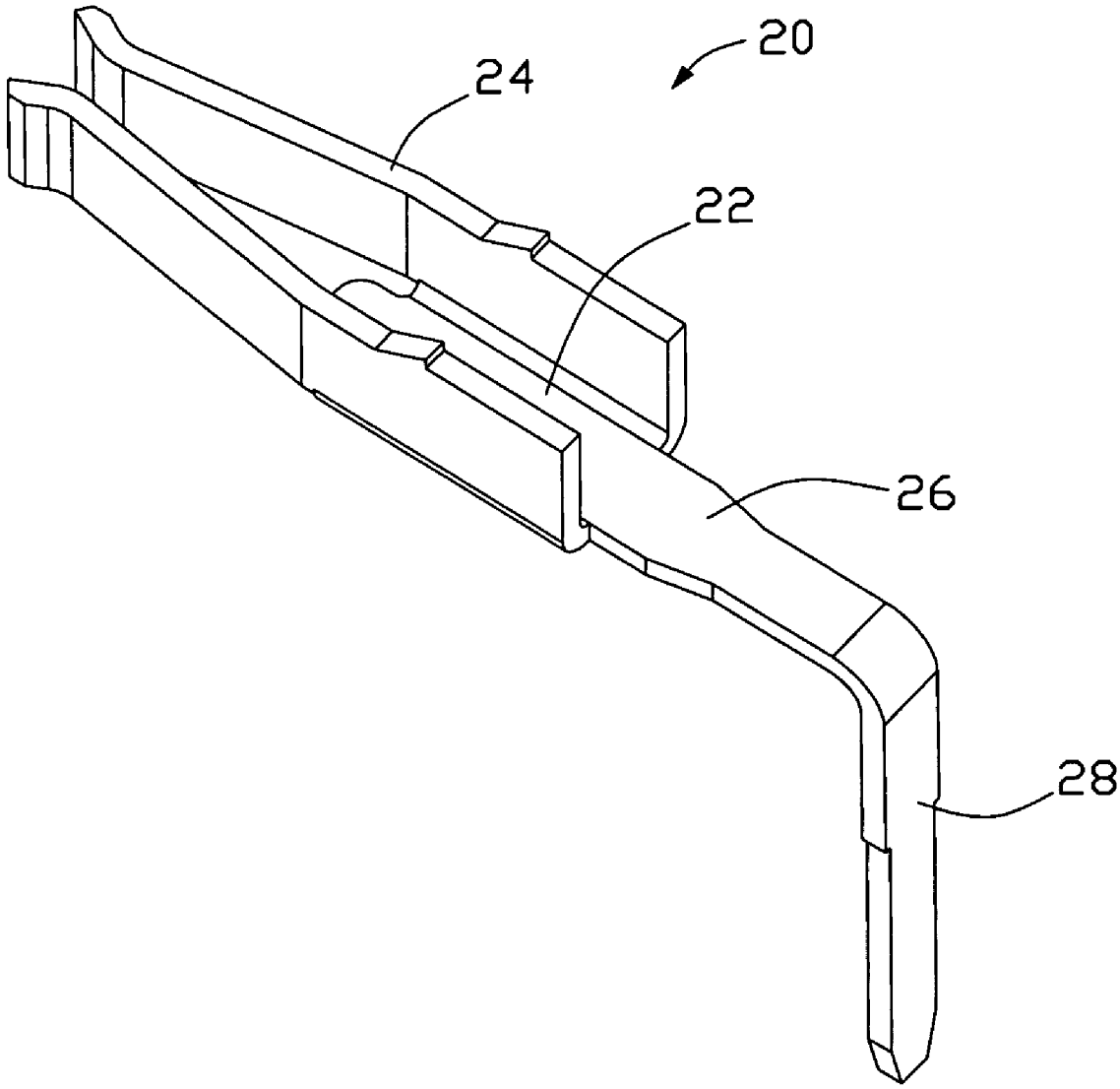
FIG. 3 is a perspective view of a first terminal of the electrical connector of FIG. 1.
Figure 4:
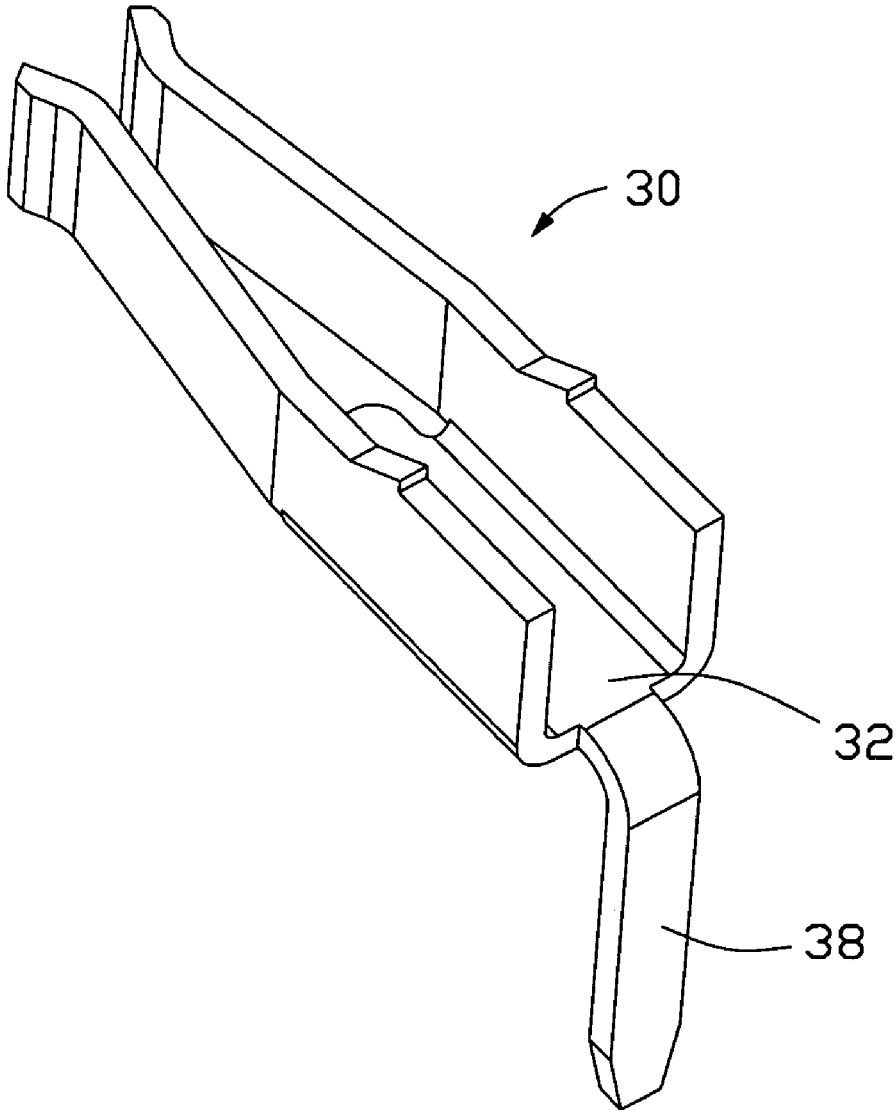
FIG. 4 is a perspective view of a second terminal of the electrical connector of FIG. 1.

Referring to FIGS. 1 to 4, an electrical connector according to an embodiment of the present invention is shown to include an elongated connector body 10 having thereof a front end 11 and a rear end 12, upper and lower rows of passageways 13 and 14 extending from the front end 11 towards the rear end 12. First and second terminals 20 and 30 are held within the respective upper and lower rows of passageways 13 and 14, respectively. In this embodiment, the connector body 10 further includes a supporting member 15 disposed adjacent the rear end 12 for supporting at least portions of the first terminals 20 (to be later described).

Each of the first terminals 20 includes a base section 22, a pair of cantilevered arms 24 extending from opposite side edges of the base section 22, an extension section 26 extending from a rear end of the base section 22, and a tail section 28 extending perpendicularly from the extension section 26 for being mounted to a mating component (not shown). The extension section 26 of each first terminal 20 extends a distance away from the rear end 12 of the connector body 10 and along a lengthwise direction of the passageway 13 associated with the corresponding first terminal 20. The distance of the extension section 26 away from the rear end 12 of the connector body 10 is determined by lateral space requirement of the tailing portion 28 of the first terminal 20 away from that of the second terminal 30 according to various embodiments of the present invention. In this embodiment, the second terminal 30 in shape is similar to that of the first terminal 20 except for having no extension portion extending between a base portion 32 and a tailing portion 38 of the second terminal 30.

In this embodiment, the supporting member 15 integrally extends from the rear end 12 of the connector body 10, and includes a plurality of parallel channels 16 in alignment with the upper row of passageways 13 for receiving at least portions of the respective extension sections 26 of the first terminals 20. It is noted that an upper face of the supporting member 15 is coplanar with a seating plane 131 of the housing defined in the corresponding passageway 13. In an alternative embodiment, the supporting member 15 may include a plurality of separate supporting segments in correspondence with the respective extension sections 26 for supporting at least portions of the respective extension sections 26, with each supporting segment including a terminal channel for receiving at least a portion of each extension section. In another embodiment, the supporting segments may be formed unitarily by continuous connection therebetween on the rear end 12 of the connector body 10. Thus, the arrangement of the supporting member 15 will prevent the free extension sections 26 of the prior art from being deflected or damaged by an external force exerted on the free extension sections 26.

In this embodiment, merely the first terminals 20 are configured to have the extension sections 26 extending a distance away from the rear end 12 of the connector body 10 so as to enable the tailing sections 28 of the first terminals 20 laterally spaced from the tailing portions 38 of the second terminals 30 for the signal and mechanical interference consideration. In an alternative embodiment, the first terminals 20 may include the extension sections 26 extending a first distance away from the rear end 12 of the connector body 10, while the second terminals 30 may also include extension portions (not shown) extending a second distance away from the rear end 12, wherein the second distance is less than the first distance, which also meets the lateral space requirement between the tailing sections 28 of the first terminals 20 and the tailing portions 38 of the second terminals 30. Thus, another supporting tabs may be provided adjacent the tailing portions of the second terminals 30 for supporting at least portions of the second terminal tailing portions 38. With such an arrangement of the supporting member and/or tabs, the free extension sections 26 of the first terminals 20 and/or the free extension portions of the second terminals 30 can be prevented from being improperly damaged or deflected due to an external force exerted thereon.

While the present invention has been described with reference to preferred embodiments, the description of the invention is illustrative and is not to be construed as limiting the invention. Various of modifications to the present invention can be made to preferred embodiments by those skilled in the art without departing from the true spirit and scope of the invention as defined by the appended claims.

What is claimed is:

1. An electrical connector comprising:

a connector body having a front end and a rear end, said connector body having passageways extending from said front end towards said rear end and separated by a separating board to form an upper row of first passageway segments and a lower row of second passageway segments, wherein said first passageway segment and said second passageway segment constitute the whole passageway;

said separating board including an extension supporting portion unitarily formed with said rear end of the connector body to extend with a distance from said rear end;

first terminals within the upper row of first passageway segments;

second terminals within the lower row of second passageway segments;

each of said first terminals including a first extension section seated upon a top surface of the extension supporting portion in a and away from said rear end of the connector body, and a tail portion; and wherein said extension supporting portion is formed with a plurality of back recesses in alignment with the respective passageway segments to supportably receive said tail portions of the corresponding terminals;

wherein each of said second terminals includes a second extension section extending a second distance away from said rear end of the connector body;

wherein said second distance of the second extension section is less than said first distance of the first extension section;

wherein each of the first terminals includes a base section extended forwardly from the first extension section in a coplanar manner, the first extension section supported by said separating board, and a pair of cantilevered arms extending perpendicularly and forwardly from opposite side edges of the base section; and wherein said pair of resilient arms define barbs on upper edges thereof to retain the contact in the corresponding passageway.

2. The electrical connector of claim 1, further comprising another supporting section adjacent said rear end for supporting the respective second extension sections.

3. An electrical connector comprising:

an insulative housing defining opposite front and rear faces;

a plurality rows of passageways formed in the housing and through the front face and the rear face;

first and second rows of terminals disposed in the corresponding passageways, respectively, each of said terminals defining a base, a pair of resilient arms extending perpendicular and forwardly from two opposite side edges of the base, an extension section extending rearwardly from a rear end of the base in a coplanar manner, and a tail section downwardly extending from a rear end of the extension section; and a supporting member unitarily extending horizontally and rearwardly from the rear face of the housing to form an upper row of first passageways segments and a lower row of first passageways segments, said supporting member defining an upward supporting face which is coplanar with a seating plane of the housing defined in each of said passageways; wherein the base is seated upon the seating plane, and the extension section is seated upon the upward supporting face;

wherein said pair of resilient arms define barbs on upper edges thereof to retain the contact in the corresponding passageway;

wherein each of said second terminals includes a section extending section extending a second distance away from said rear end of the connector body;

wherein said second distance of the second extension is less than said first distance of the first extension section; and wherein the electrical connector further comprises another supporting section adjacent said rear end for supporting the respective second extension sections.

4. The electrical connector as claimed in claim 3, wherein said supporting member defines a plurality of channels to receive the tail sections of the corresponding contacts, respectively.

* * * * *